United States Patent [19]

Asahi

[11] 4,225,252

[45] Sep. 30, 1980

[54] CHARACTER SELECTION FOR SINGLE ELEMENT PRINTER

[75] Inventor: Tetsuma Asahi, Kodaira, Japan

[73] Assignee: Silver Seiko Co., Ltd., Kodaira, Japan

[21] Appl. No.: 889,406

[22] Filed: Mar. 23, 1978

[30] Foreign Application Priority Data

Mar. 25, 1977 [JP] Japan ..... 52-32152

[51] Int. Cl.[2] ..... B41J 23/02

[52] U.S. Cl. ..... 400/161.5; 400/163.1; 400/168; 400/257

[58] Field of Search ..... 400/161.1, 161.2, 161.3, 400/161.4, 161.5, 162, 162.1, 163.1, 163.2, 163.3, 164.5, 164.6, 168, 169, 257

[56] References Cited

U.S. PATENT DOCUMENTS

| | | | |
|---|---|---|---|
| 2,127,508 | 8/1938 | Fuchs | 400/161.5 X |
| 3,666,070 | 5/1972 | Schaefer | 400/161.5 |
| 3,738,471 | 6/1973 | Van Der Werff et al. | 400/161.2 |
| 3,771,635 | 11/1973 | Miles et al. | 400/168 X |
| 3,876,053 | 4/1975 | Giolitti et al. | 400/257 X |
| 3,885,662 | 5/1975 | Schaefer | 400/161.5 |
| 3,892,304 | 7/1975 | Shakib | 400/161.5 |
| 3,948,381 | 4/1976 | McDaniel et al. | 400/161.5 |
| 3,981,386 | 9/1976 | Abell et al. | 400/161.5 |
| 3,983,984 | 10/1976 | DeKler | 400/161.4 |
| 4,059,184 | 11/1977 | Redding et al. | 400/161.5 |

FOREIGN PATENT DOCUMENTS

| | | | |
|---|---|---|---|
| 2003158 | 8/1971 | Fed. Rep. of Germany | 400/161.1 |
| 2623969 | 12/1977 | Fed. Rep. of Germany | 400/161.2 |

*Primary Examiner*—Ernest T. Wright, Jr.
*Attorney, Agent, or Firm*—Armstrong, Nikaido, Marmelstein & Kubovcik

[57] ABSTRACT

There is disclosed a selection mechanism for a single element printer comprising an operating link connected with the print element for the driving rotation thereof and having a first and a second input portion, and a modifying member having the link mounted thereon for pivotal motion about the first input portion. A cam follower is provided on the modifying member for engagement by a case shift cam, which is operable independent of the print shaft, to shift between a pair of locations in either of which a first character selection means cooperates with the modifying member to position the latter in either of two distinctive positions so that the first input portion of the operating link is positionable to any of four positions. The second input portion of the link is associated with a second character selection means for positioning the link to any of a plurality of pivotal positions relative to the first input portion thereof. The selection mechanism is simply constructed by connecting all the input means to a single operating link mounted inclusively on the carrier and, therefore, the selection mechanism can be manufactured at a low cost. Maintenance and adjustment of the printer can also be greatly minimized.

23 Claims, 15 Drawing Figures

| | m | x | u | d | c | l | t | n | e | k | h | b |
|---|---|---|---|---|---|---|---|---|---|---|---|---|
| +5 | 1 | 1 | 0 | 0 | 0 | 0 | 0 | 0 | 0 | 0 | 0 | 0 |
| +3 | 0 | 0 | 1 | 1 | 0 | 0 | 0 | 0 | 0 | 0 | 0 | 0 |
| +1 | 0 | 0 | 0 | 0 | 1 | 1 | 0 | 0 | 0 | 0 | 0 | 0 |
| -1 | 0 | 0 | 0 | 0 | 0 | 0 | 1 | 1 | 0 | 0 | 0 | 0 |
| -3 | 0 | 0 | 0 | 0 | 0 | 0 | 0 | 0 | 1 | 1 | 0 | 0 |
| -5 | 0 | 0 | 0 | 0 | 0 | 0 | 0 | 0 | 0 | 0 | 1 | 1 |
| +1 | 1 | 0 | 1 | 0 | 1 | 0 | 1 | 0 | 1 | 0 | 1 | 0 |

CHARACTER SELECTION FOR SINGLE ELEMENT PRINTER

BACKGROUND OF THE INVENTION

1. Field of the Invention

This invention relates to a printer, especially a printer having a single print element mounted for rotation to present different character types such as letters, symbols, numbers thereon in a printing position.

2. Description of the Prior Art

In a printer of this type, the print element is of a globe-like configuration cut away in its top and has a number of characters such as letters, symbols, marks, etc. in rows and columns, for example, a total of 88 characters in 4 rows and 22 columns, or a total of 96 characters in 4 rows and 24 columns arranged thereon. Usually, upper case characters are arranged in 11 or 12 columns on one semicircular face of the globe-shaped element and lower case characters are arranged on the other semicircular face. Selection of the characters thus arranged is effected by tilting and rotating the print element to present a desired character in the printing position confronting a platen.

Various selection systems have been proposed for controlling the print element in such a single element printer. However, in such a printer, especially of the type in which the print element is mounted on a carrier travelling along a platen or a printing line, it has been proposed that all members of the selection mechanism be provided together in the carrier in order to simplify the mechanism, maintenance and adjustment etc. and to improve responsiveness.

U.S. Pat. No. 3,666,070 discloses a printer having a mechanism comprising: a differential mechanism including a pinion connected to the print element for rotation therewith, a sector gear meshing with said pinion, an axle pivotally supporting the sector gear, and a link pivoted about an axis of the pinion and having the axle fixed thereon; a first input means including a face cam and a cam follower for selectively positioning the link in any of a predetermined plurality of pivotal positions, and a spring for urging the cam follower toward the face cam; a second input means including the front cam, another cam follower and a similar spring for selectively positioning the sector gear in any of a predetermined plurality of pivotal positions relative to the axle. All the components are provided together in the carrier thereby selecting any of 11 characters included in one row on a print head, i.e., the print element.

However, the mechanism above described cannot be suitably employed for the printer requiring a printing speed as high as 16 or 17 letters/sec, which is required in an ordinary electric typewriter, which includes a print element, as abovementioned, with 22 or 24 columns of characters, because in the disclosed printer a case shifting mechanism for selecting either of the upper or the lower case characters which is necessary in conventional typewriters is not incorporated, and because when such a print element is rotated in correspondence with the high printing speed, rotational inertia of the print element may become great enough to extend the springs provided in the mechanism excessively beyond the selected angular distance of the element, which will prevent correct selection of a character column.

A German patent application No. P 20 03 158.7-27, laid open on Aug. 19, 1971 discloses an improved selection mechanism which has eliminated such defects. In this selection mechanism, a pinion connected with the print head for rotation therewith is engaged with a pivotable sector gear which is form-closedly connected with a differential lever system including a pair of pivotal levers each adapted to be form-closedly driven by two individually and cyclically drivable eccentric discs, and the case shifting operation is accomplished by following the steps of first pivoting the sector gear in a direction to bring same out of engagement with the pinion, second rotating the pinion 180 degrees through a separate means, and finally pivoting the sector gear in the other direction to reestablish appropriate engagement with the pinion. The disengagement of the sector gear from the pinion, however, causes a problem in that the print head occasionally becomes incorrectly positioned relative to a case shift key, especially where the shift key is successively depressed and released rapidly, so that the printing of a character is in the wrong case. A wrong character may be printed in response to a character key depression after a case shifting operation.

A similar problem may be considered inherent to the structure of a selection mechanism for a single element printer proposed by another U.S. Pat. No. 3,892,304, entitled "Single Print Element Print Carrier with Self-Contained Selection Function." In the printer, the selection mechanism is incorporated in a carrier and includes a multichannel barrel cam adapted to be driven through a cyclically driven key-responsive print shaft to laterally translate a selected length, and a dual rack member connected with the barrel cam for movement thereby upon translation thereof and having a pair of parallel racks disposed to be alternatively engaged with a pinion for rotation of the print element. In the case shifting operation, the rack member is first moved in a first direction, with one of the racks being engaged with the pinion, to rotate the pinion 90 degrees in a direction, and then the other rack is switched to be engaged with the pinion whereafter the rack member is moved back in the opposite direction to rotate a further 90 degrees in the same direction so that the print head is rotated a total of 180 degrees. The selection mechanism has another disadvantage in that additional specific mechanisms such as a no print key mechanism, which apparently makes the carrier more complicated and contributes to an undesirable increase in the weight of the carrier, must be incorporated for a disabling operation of printing means, ribbon mechanisms or letter feed mechanism during a case shifting operation since the printer would otherwise effect unnecessary printing of a certain character, ribbon lift and feed, or letter feed of the carrier relative to the platen.

SUMMARY OF THE INVENTION

Accordingly, it is a principal object of the present invention to provide a character selection mechanism for a single element printer which enables constant and continuous connection with the single print element to contribute to correct printing on the machine.

It is another object of the invention to provide for a single element printer, a selection mechanism including a differential mechanism which is compatible with a case shift mechanism so that a case shifting operation is effected through the differential mechanism.

It is still another object of the invention to provide a selection mechanism for a single element printer which accomplishes a case shifting operation independent of the print shaft.

It is a further object of the invention to provide for a single element printer, a selection mechanism including a differential mechanism which is lockable in position preceding the start of printing motion of the print element to assure correct selection of a selected character during high speed printing.

It is a still further object of the invention to provide in a differential mechanism of a selection mechanism for a single element printer, a simple and efficient device having a dual function to participate in character selection and lock the differential mechanism in position preceding the printing.

It is an additional object of the invention to provide a simple arrangement for establishing an constant and continuous connection between a differential mechanism of a selection mechanism and the print element which is rockable around an axis relative to the differential mechanism for printing of a selected character.

A selection mechanism for a single element printer according to the present invention comprises an operating link connected with the print element for rotation therewith and having a first and a second input portion, and a modifying member having the link mounted thereon for pivotal motion about the first input portion. A cam follower is provided on the modifying member for engagement by a case shift cam, which is operable independent of the print shaft, to shift between a pair of locations in either of which a first character selection means cooperates with the modifying member to position the latter in either of two distinctive positions so that the first input portion of the operating link is positionable to any of four portions. The second input portion of the link is associated with a second character selection means for positioning the link to any of a plurality of pivotal positions relative to the first input portion thereof.

BRIEF DESCRIPTION OF THE DRAWING

The drawing shows embodiments of the printer according to the present invention in which.

DETAILED DESCRIPTION OF THE EMBODIMENTS

Figure 1:
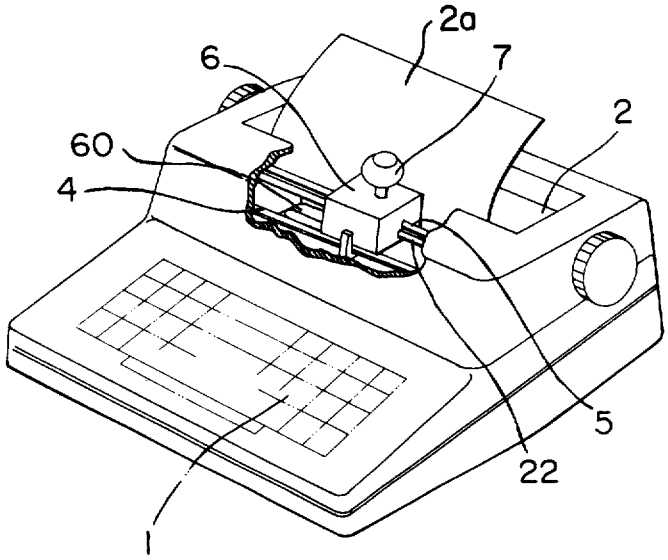
FIG. 1 is a partially cut away exterior view of the printer.

Now referring to the drawing, the invention is more fully described.

Figure 11:
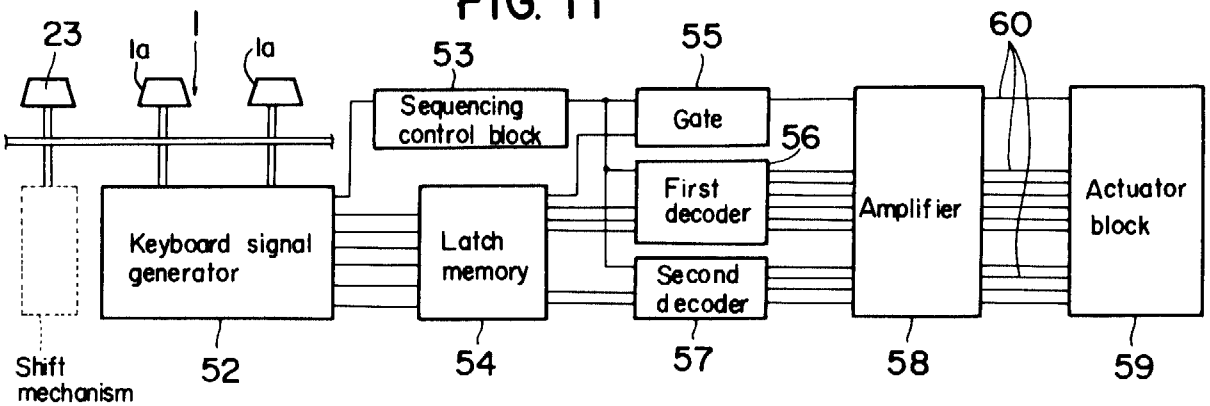
FIG. 11 is a block diagram showing a circuit network for transmitting control signals to the carrier.

A typewriter as shown in FIG. 1 is provided with a keyboard 1 having a plurality of individually operable character keys 1*a* (FIG. 11) and ordinary function keys, such as a case shift key 23 (FIGS. 2 and 11), and a fixed platen 2 adapted to hold a paper 2*a* and perform line feeding through an ordinary line feeding system.

Figure 2:
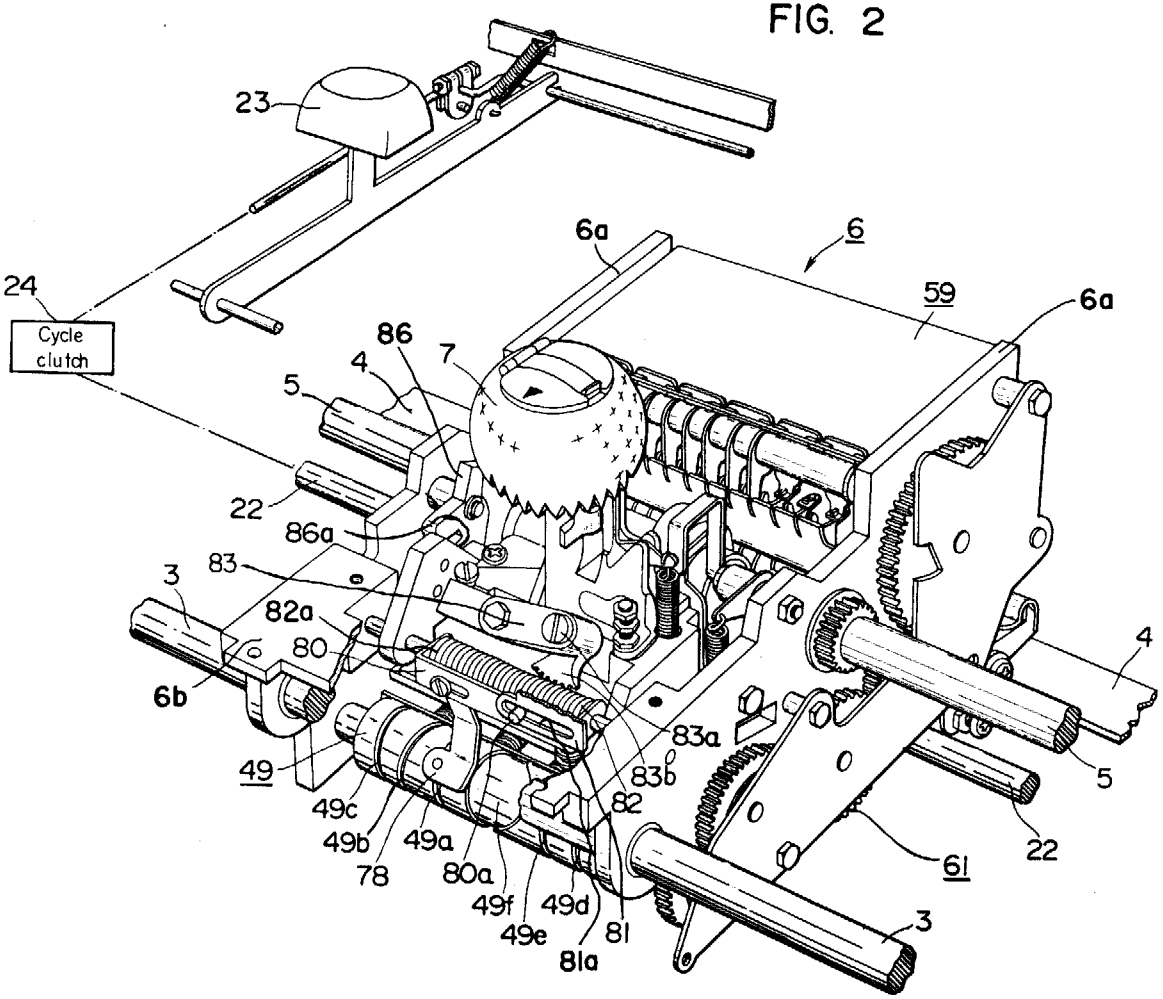
FIG. 2 is a perspective view of a carrier seen from behind the printer body.
Figure 3:
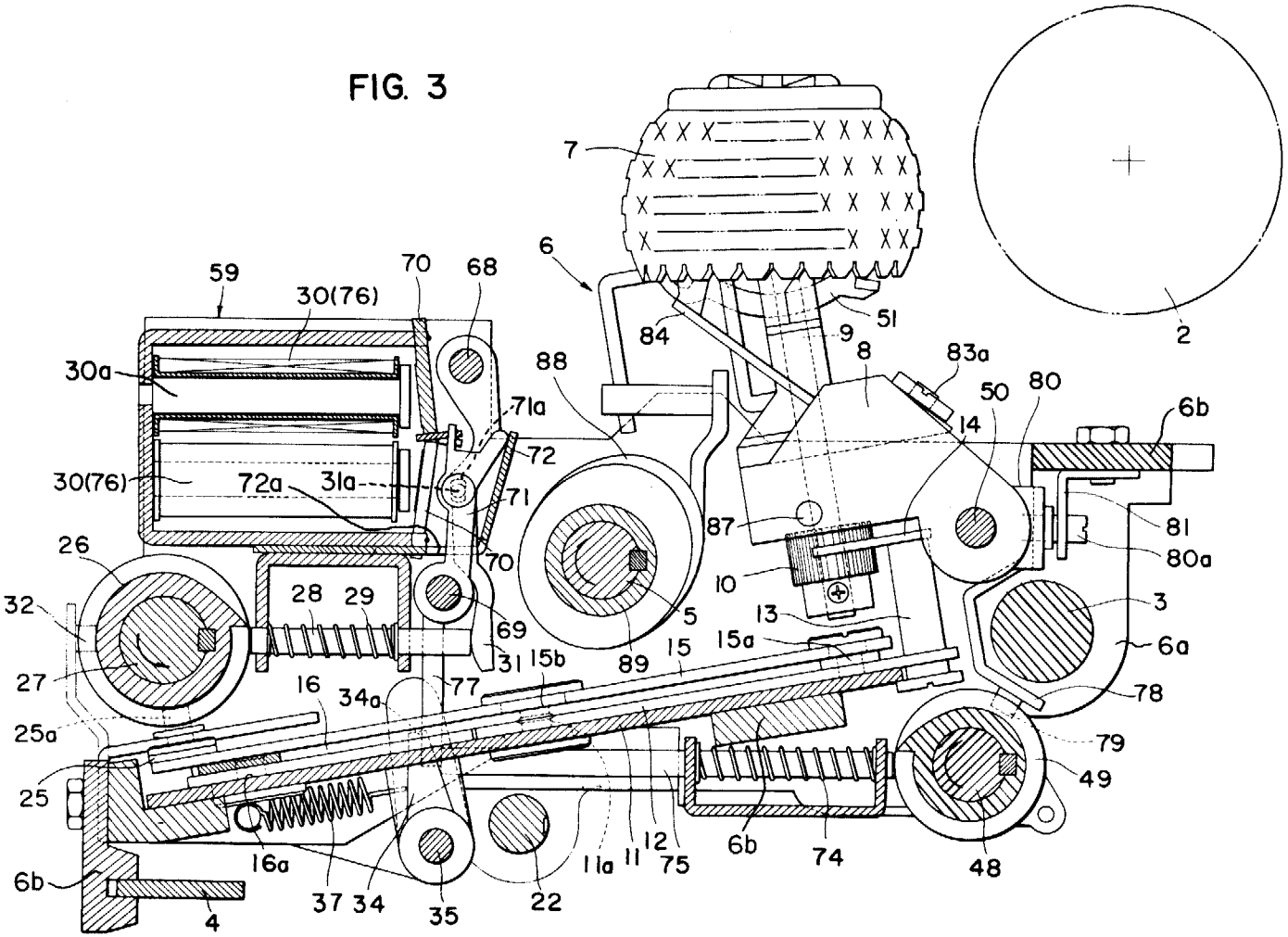
FIG. 3 is a vertical sectional view of the carrier.

A pair of guide members 3 and 4 are positioned in front of the platen 2 (right side in FIG. 3), in parallel therewith. The pair of guide members 3 and 4 have configurations of a rod and a bar respectively (FIGS. 2 and 3). On the guide members 3 and 4 is slidably mounted a carrier 6 which carries a single element print head 7 of a globe-like configuration having a plurality of characters such as letters, numbers and symbols embossed on its circumferential face in rows and columns. The carrier 6 can slide for letter feeding relative to the platen 2 on each printing cycle through an ordinary letter feeding system.

In parallel with the platen 2, is arranged a print shaft, i.e., a main shaft 5 between both side walls 6*a* of the frame 6*b*. The print shaft 5 is connected to an output shaft of an actuating motor (not shown) through a cycle clutch (not shown). The cycle clutch, as known in the art, is constructed to engage in response to the depression of a character key 1*a* on the keyboard 1 thereby imparting to the print shaft 5 a clockwise rotation as shown in FIG. 3. On the print shaft 5 is mounted a sleeve 89 (FIG. 3) axially slidable thereon and rotatable therewith. The sleeve 89 is provided with a plurality of ordinary cams including a conventional print cam (not shown).

As shown in FIG. 3, the print head 7 is rotatably and tiltably mounted on a rocker 8 which is pivoted about a rod 50 arranged between both side walls 6*a* of the frame 6*b* of the carrier 6 in parallel with the platen 2 and a print line. A pin 87 (FIG. 3) positioned between two arms 86*a* of a bifurcated portion of a bellcrank 86 (FIG. 2) which acts as a cam follower of the print cam, is fixed to the rocker 8, whereby the rocker 8 rotates clockwise in response to the rotation of the print shaft 5 as shown in FIG. 3, actuating the print head 7 to strike the platen 2 to print a character (when the shaft 5 rotates by 195°).

In addition to the actuating mechanism for the print head 7 and a print selection mechanism hereinafter disclosed, the carrier 6 is provided with various mechanisms such as a locking mechanism including a cam 88 and a lever 51 (FIG. 3) for locking the head 7 against rotation and tilt, during printing, and a ribbon mechanism (not shown) for effecting ribbon lift and feed. Such mechanisms are omitted for a simplified description because it is not within the scope of this invention.

Selection of the letters or symbols on the print head 7 is effected, as known in the art, by selecting a pertinent row and column of a desired character on the head 7, in other words, by selectively rotating and tilting the head 7 thereby positioning the desired character exactly in front of the platen 2. The control signals required for selection of characters on the print head 7 other than for a case shift (disclosed hereinafter) are transmitted from the keyboard 1 to the carrier 6 through control signal lines 60 (FIG. 1).

The keyboard 1 is provided with a keyboard signal generator 52 (FIG. 11) which provides control signals.

The keyboard signal generator 52 may include a contact switch mechanism or the like having a plurality of contact switches selectively operable by a known interposer provided for each key lever. Included in generator 52 are six output terminals for code signals representing an operated key and another output terminal for a signal representing operation of any key which is to be generated with a smaller time lag than the code signals. The seventh output is connected to a sequencing control block 53 for sequentially controlling the entire circuit motion until completion of printing. The six outputs are connected to a latch memory unit 54 for memorizing the code signals. Two of the six output terminals of the latch memory unit 54 are connected to a second decoder 57 which is connected through amplifiers 58 to four solenoids 76 (FIG. 3) in an acutating block 59 for controlling the tilting motion of the print head 7. The remaining four output terminals are employed to control rotation of the print head 7. One of the four output terminals is connected to a gate 55 which is connected through an amplifier 58 to a solenoid 45 (FIG. 7) in the actuating block 59 and the remaining three output terminals of the four outputs are connected to a first decoder 56 which is connected through amplifiers 58 to solenoids 30 (FIG. 3) in the actuating block 59. The first and second decoders 56 and 57 have respectively six and four output terminals for selecting characters arranged in six columns and four rows on the print head 7 as explained hereinafter. There is mounted on the carrier 6 a unit including the actuating block 59 for effecting selection of characters in accordance with the control signals transmitted to the carrier 6 through the control lines 60.

A rotate selection mechanism will now be described.

Figure 4:
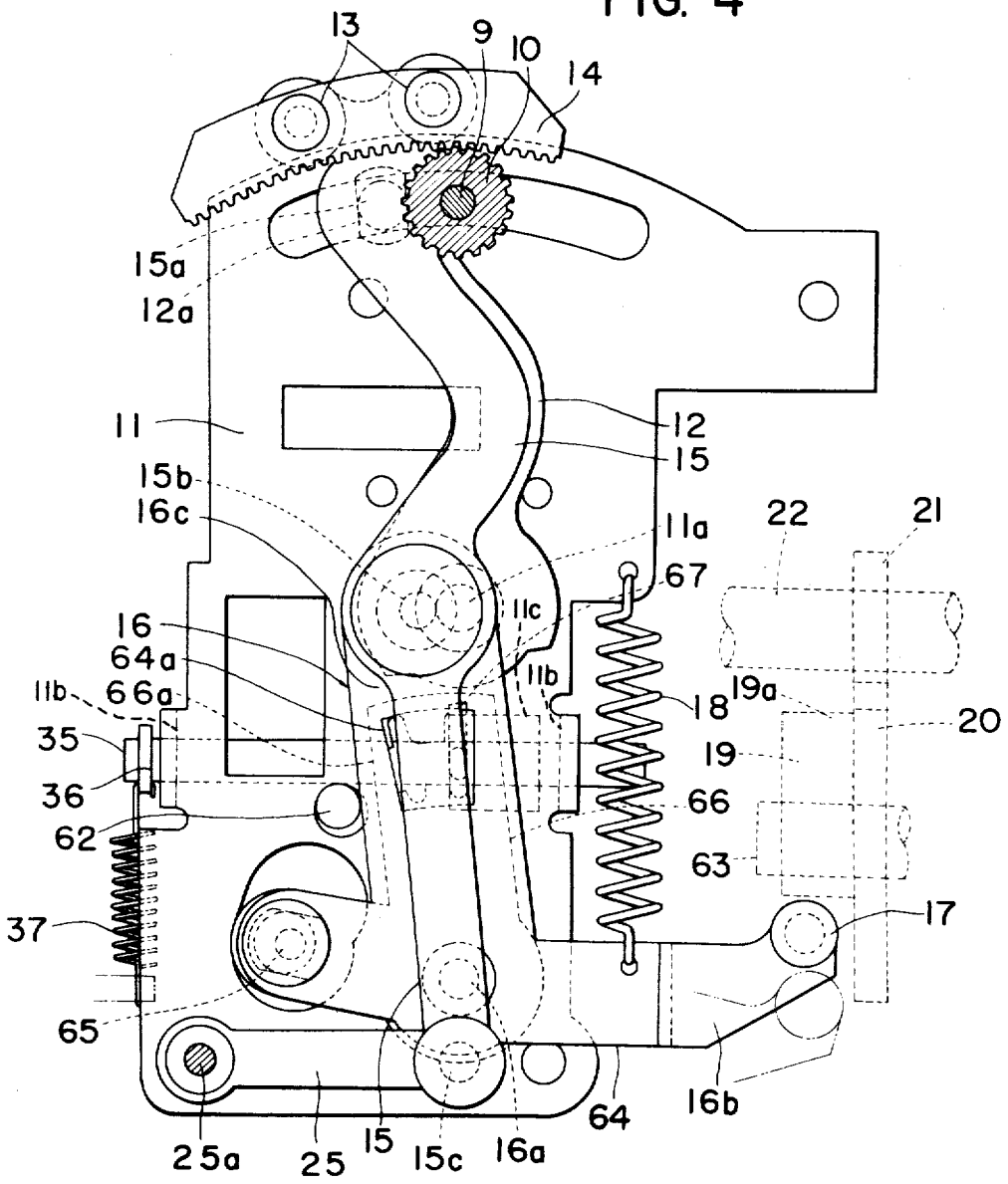
FIG. 4 is a plan view of a differential mechanism for selecting a column of characters.

Referring to FIGS. 3 and 4, the print head 7 is mounted on the top of a rotary shaft 9 rotatably provided in the rocker 8, and supported by a known method wherein it can tilt in relation to the shaft 9 and rotate therewith. A pinion 10 is fixed to the bottom end of the rotary shaft 9, the pinion 10 always meshing with a sector gear 14. The sector gear 14 is fixed to posts 13 mounted at the tip of a lever 12 which is pivoted at 11*a* on a base plate 11 firmly attached to the frame 6*b* of the carrier 6 whereby the gear 14 can rotate about the axis 11*a*.

When the rocker 8 rotates or rocks around the rod 50 by a predetermined angle to actuate the print head 7 for printing, the pinion 10 rotates therewith to cause relative movement with the sector gear 14. In order to maintain the engagement of the pinion 10 with the sector gear 14 notwithstanding the relative movement, the pinion 10 is preferably provided with an ample axial length, the gear 14 is preferably arranged in such a position that the axle 50 almost aligns with the rotation plane of the gear 14, and the axis of the pinion 10 i.e., the axis of the shaft 9 is preferably disposed in such a position that the rotation plane of the gear 14 is perpendicular to the axis when the rocker 8 rotates about half of the predetermined angle. The axis 11*a* of rotation of the sector gear 14 is also preferably disposed in alignment with a rotating or rocking plane of the print head 7 thereby to assure a reliable engagement of the pinion 10 with the gear 14. Accordingly, the sector gear 14 moves along a path substantially perpendicular to the rocking plane.

A slot 12*a* is formed in lever 12 (FIG. 4) at one end and a pin 15*a* at one end of an operating link 15 is inserted therein. The operating link 15 is related to two independent input members, one of which is a follower link 25 connected at its other end thereof through a pin 15*c* normally disposed substantially in the rocking plane of the print head 7. The follower link 25 is provided at its other end with a follower pin 25*a* which always meshes with a follower groove 26*a* (FIG. 6) of a barrel cam 26 mounted on a rotary shaft 27 for axial translation along and rotation about its axis. When the print shaft 5 makes one revolution to effect one revolution of the rotary shaft 27 through the gear assembly 61 (FIG. 2) at a transmission ratio of 1:1 thereby axially translating the barrel cam 26 in a manner hereinafter described, the translation of the barrel cam 26 is transmitted to the link 15.

The operating link 15 is in its middle portion pivoted about an axle 15*b* which is mounted at the tip end of an arm 16*c* of a bellcrank-like modifying link 16. The modifying link 16 is pivotally mounted on the base plate 11 about a pivot 16*a* disposed in the rocking plane of the print head 7 and is urged in a counterclockwise direction (FIG. 4) around the pivot 16*a* through a tension spring 18 provided between another arm 16*b* and the base plate 11. The counterclockwise rotation of the link 16 is restricted by a stop 62 adjustably fixed on the base plate 11. A roller 17 is rotatably mounted at the tip of the arm 16*b* of the modifying link 16. The roller 17 acts as a cam follower of a case shift cam 19 and is urged into contact with the cam 19 by the spring 18. The shift cam 19 is actuated by a mechanism mentioned hereinbelow to shift the roller 17 between two positions shown respectively by a solid line and a dotted line in FIG. 4 thereby displacing the link 16 between the original position and a shifted position. The axle 15*b* which is the input member of the operating link 15 is shifted from the original position to the shifted position symmetrically arranged about the axis 11*a*, in other words, on both sides of the rocking plane of the print head 7, as shown respectively by a solid line and link line in FIG. 5. From the foregoing, it is understood that the shift cam 19 acts as an input member for the modifying link 16 and accordingly for the axle 15*b*.

As particularly shown in FIG. 4, the modifying link 16 consists of two members, namely a first member 64 comprising the two arms 16*b* and 16*c* and a second member 66 which is pivoted about the axle 16*a* with the first member 64 and which is angularly adjustable in relation to the member 64 through an eccentric screw 65. The second member 66 has, as seen in FIG. 4, an arm 66*a* partially overlapping the arm 16*c* of the first member 64. In the top portion of said arm 66*a* is formed a generally H-shaped cam slot 33 as particularly shown in FIG. 5, while a fan-shaped window opening 64*a* of a size including said cam slot 33 is formed in the corresponding portion of the arm 16*c* of the first member 64.

Figure 5:
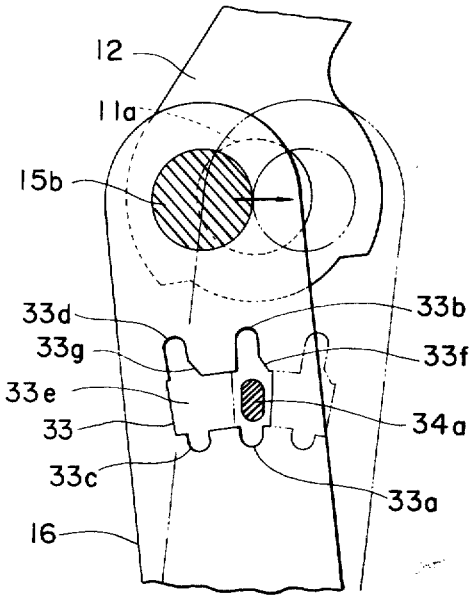
FIG. 5 is a partially enlarged view of FIG. 4.

Referring to FIG. 5 (in which the cam slot 33 is shown as if formed in the first member 64 to simplify explanation only), the cam slot 33 consists of four groove portions 33*a*, 33*b*, 33*c* and 33*d*, and a mutually communicating portion 33*e*. The groove portions 33*a* to 33*d* are so constructed as to engage with a top portion 34*a* of a lock lever 34 mentioned hereinbelow to thereby lock the second member 66 and the modifying link 16. In the second member 66, side portions respectively adjacent to the grooves 33*b* and 33*d* positioned in the upper part in FIG. 5 are diagonally cut to form cam edges 33*f* and 33*g*.

An elongated slot 67 is formed in the base plate 11 (FIG. 4) along the rocking plane of the print head 7.

The modifying link 16 is initially disposed in such a position that the groove 33*a* in the second member 66 aligns with the elongated slot 67 (as shown by a solid line in FIG. 5) and is shiftable to bring the slot 67 into alignment with the groove 33*c* (shown by a link line in FIG. 5).

The lock lever 34 (FIG. 3) is fixed to a rod 35 provided between downwardly bent portions 11*b* of the base plate 11 so that it can rotate together with the rod 35 selectively at predetermined angles in the clockwise or counterclockwise direction as seen in FIG. 3. The top portion 34*a* of the lock lever 34 extends upward through the elongated slot 67 in the base plate 11 and the cam slot 33 in the second member 66 to reach the window opening 64*a* in the first member 64 (FIG. 3) and is initially disposed between the portions 33*a* and 33*b* of the cam slot 33 (FIG. 5). Therefore, upon rotation of the lock lever 34, the top portion 34*a* selectively engages with the groove portion 33*a* or 33*b* thereby locking the modifying link 16 against rotation about the axle 16*a*, and eventually locking the input portion 15*b* of the operating link 15. In order to further assure locking, the base plate 11 is adjustably provided with a pair of restricting members 11*c* (only one of which is illustratively shown in FIG. 4) on the under face thereof adjacent to the elongated slot 67 (in FIG. 4) to laterally restrict the top portion 34*a* of the lock lever 34.

As described above, in the original and shifted positions of the modifying link 16, the portions 33*a* and 33*c* are respectively brought into alignment with the elongated slot 67 of the base plate 11. Therefore, when the lock lever 34 swings in a counterclockwise direction (in FIG. 3), the top portion 34*a* comes into engagement with the portions 33*a* or 33*c*. The other portions 33*b* or 33*d* do not align with the elongated slot 67 either in the initial or shifted positions, because the portions 33*b* and 33*d* are formed with a predetermined angular dislocation from the portions 33*a* and 33*c* about the axle 16*a* of the modifying link 16. Therefore, the modifying link 16 must be rotated in a clockwise direction (FIGS. 4 and 5) by the predetermined angular dislocation in order to bring the portions 33*b* and 33*d* into engagement with the lock lever 34 (FIG. 3) at the clockwise swing thereof. The cam edges 33*f* and 33*g* are formed adjacent to the portions 33*b* and 33*d* respectively for aiding the above motion. With this construction, the lock lever 34 engages with the cam edges 33*f* or 33*g* during its clockwise rotation as seen in FIG. 3 to rotate and displace the modifying link 16 clockwise in FIG. 4 from the initial or shifted position by the angular dislocation and, so, displace the axle 15*b* of the operating link 15 by a predetermined length. The length of this displacement is so determined as to coincide with the angular size by which the print head 7 rotates in correspondence with a distance between columns of characters arranged thereon.

As aforementioned, the lock lever 34, in cooperation with the cam means 33*f* and 33*g*, and the mechanism for activating the lever 34 acts as the second input means for the modifying link 16 for displacing the axle 15*b* of the operating link 15 from its initial position to the shifted position by the predetermined length.

Figures 9, 10:
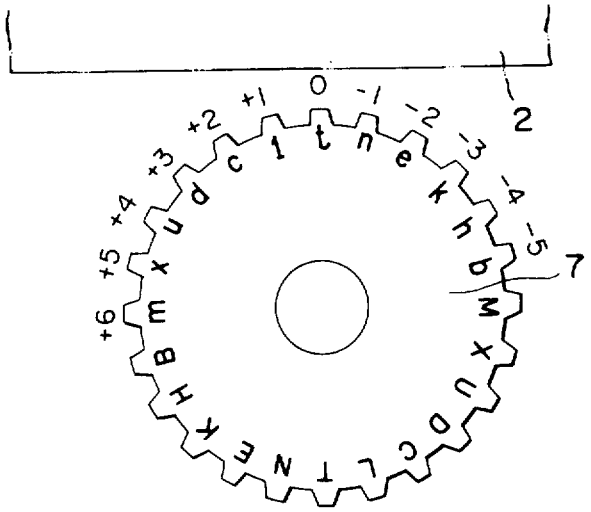
FIG. 9 is an explanatory view of rotation system of a print head.
FIG. 10 is a chart showing combinations of characters to be selected.

Now, referring to FIGS. 4, 9, 10, the selection of characters on the print head 7 which comprises 96 characters in all arranged in 24 columns and 4 rows is described.

In FIG. 9, 24 characters in the second row from the top of the 4 rows on the print head 7 are shown as examples for explanation. On the print head 7 are symmetrically arranged 12 lower case letters, i.e., small alphabetic letters on the semicircular face confronting the platen 2 in the normal or unshifted position and 12 upper case letters, i.e., capital alphabetic letters corresponding to small letters on the opposite semicircular face. In the ordinary position of the head 7, a small letter "t" is disposed at the printing position exactly confronting the platen 2, from which the head 7 is selectively rotated within a range of 90° clockwise and 75° counterclockwise to select a desired letter from the 12 small letters. For convenience of explanation, the clockwise rotation and counterclockwise rotation of the print head 7 are respectively represented as "+" and "−", and a pitch of rotation corresponding to one column distance is represented as 1 pitch. The selection of letters, therefore, is effected by rotating the print head 7 by desired pitches from "+6" to "−5" as shown in FIG. 9. For example, the letter "x" corresponding to "+5" can be selected by rotating the head 7 by 5 pitches clockwise and the letter "e" corresponding to "−2" can be selected by rotating the head 7 by 2 pitches counterclockwise.

The selection of one letter out of the 12 letters on the semicircular face of the print head 7 is performed by selectively operating the two input members, i.e., the barrel cam 26 and the lock lever 34. The first input member, that is, the barrel cam 26 selectively positions the pin 15*c* (FIG. 4), which is the input portion of the operating link 15, to 6 positions corresponding to the rotation left or right of the head 7 by +5, +3, +1, −1, −3 and −5 pitches respectively from the initial or normal position shown in FIG. 4. The selective positioning of the pin 15*c* actuates the operating link 15 to rotate about the axle 15*b* thereby rotating the lever 12 about the axle 11*a* through connection of the pin 15*a* and the slot 12*a*, and, actuates the print head 7 to rotate counterclockwise or clockwise by selected pitches through engagement of the sector gear 14 and the pinion 10.

Meanwhile, the second input member or lock lever 34, when it rotates clockwise in FIG. 3, in its selecting motion, actuates the modifying link 16 clockwise in FIG. 4. The axle 15*b* or another input portion for the link 15 is displaced rightwardly from the initial position shown in FIG. 4 thereby swingingly displacing the link 15 about the pin 15*c*. Consequently, the print head 7 rotates clockwise by 1 pitch, i.e., "+1" pitch. It can be clearly understood, therefore, that one of the letters "m", "u", "c", "t", "e" and "h" corresponding to the rotation of the print head 7 of +6, +4, +2, 0, −2 and −4 pitches can be selected by combining the two rotary motions effected respectively by the movement of the barrel cam 26 and the displacement of the modifying link 16.

When the lock lever 34 tilts counterclockwise in FIG. 3, the displacement of the modifying link 16 does not occur, and one of the letters "x", "d", "l", "n", "k" and "b" corresponding to the +5, +3, +1, −1, −3, and −5 rotations of the print head 7 can be selected.

Selection of the upper case letters i.e., capital letters can be effected by pressing down a shift key 23 (FIG. 2) to drive the shift cam 19 to displace the axle 15*b* of modifying link 15 almost symmetrically about the axle 11*a* (FIG. 5) thereby to rotate the head 7 by 180° so that the capital letter "T" faces the printing position on the platen 2. In this rotated position of the print head 7, the barrel cam 26 and the lock lever 34 are selectively actuated in the same manner as in the case of selecting the small letters, whereby selection of the capital letters is completed.

To summarize the above explanation, the selection of a column of letters is performed by three steps, namely, a first step of selecting either one of the upper or lower case letters, on either of the semicircular faces; a second step of selecting either one of the two groups of letter columns included in the selected semicircle; and a third step of selecting one letter column out of the selected group of letter columns. For accomplishing the three steps of selection, the input means including the shift cam 19, the input means including the lock lever 34 which acts in cooperation with the cam slot 33 of the modifying link 16, and the input means including the barrel cam 26 are respectively provided. The last input means of the three may be deemed as means for selecting one of 6 pairs of letter columns included in the semicircular face selected in the first step, and the input means including the lock lever 34 may be deemed as means for finally selecting one letter column out of the selected pair of columns.

Figure 6:
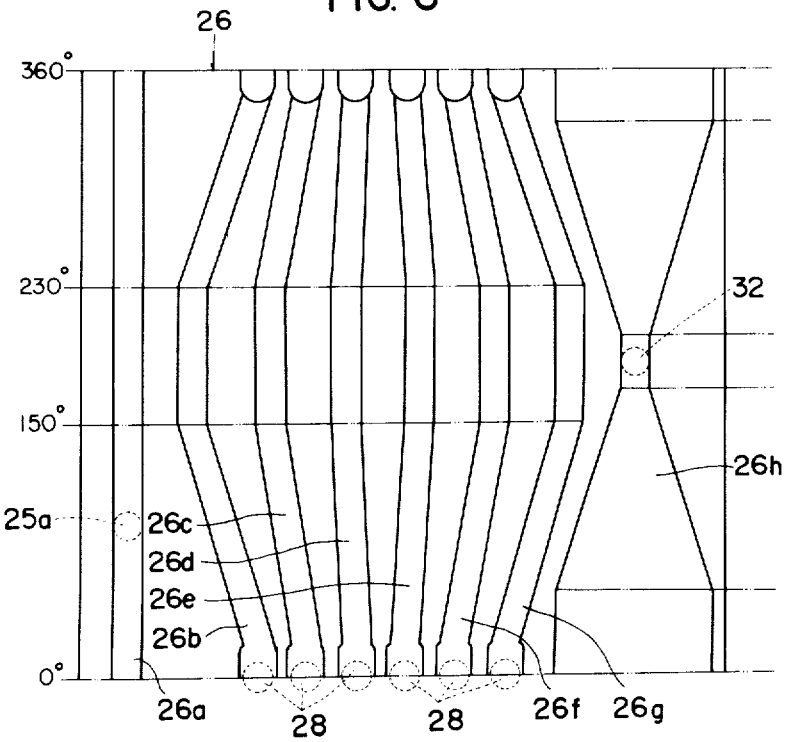
FIG. 6 is a developed view of a first barrel cam.

The input means including the barrel cam 26 will now be described. In FIG. 6 the barrel cam 26 is formed with the follower groove **26*a*, six selection grooves 26*b*, 26*c*, 26*d*, 26*e*, 26*f* and 26*g*, and a return groove 26*h*. Six selector pins 28 (FIG. 3) are arranged with their tops in alignment with the six selection grooves 26*b* to 26*g*. Each of the selector pins 28 is urged by a compression spring 29 rightward in FIG. 3, in a direction wherein the pin 28 withdraws from the grooves 26*b*–*g*. The other end of the pin 28 contacts a free end of an operating lever 31 pivoted about a rod 68. Each operating lever 31 is connected by way of a pin-and-slot connection 31*a*, 71*a* to a lever 71 which is pivoted about a rod 69 and connected at its one end to an armature 70 of an electromagnet 30. The lever 71 abuts on a common stop member 72 at its upper end through the action of the spring 29 thereby to be checked. Stop member 72 also checks lever 31. The stop member 72 has formed therein guide slits 72*a* for guiding the levers 31 and 71 as seen in FIG. 3. Each armature 70 is hinged respectively at its upper or lower end and normally held apart from the iron core 30*a* of the electromagnet 30 by way of the spring 29**.

The electromagnets 30 are controlled through the control lines 60 (FIG. 1). When one of the electromagnets 30 is selectively excited to rotate the armature 70, the corresponding selector pin 28 is urged through said connections to insert its end into one of the grooves **26*b*–*g* of the barrel cam 26 against the spring 29. Then with one revolution of the shaft 27, the barrel cam 26 axially moves following the configuration of the groove 26*b* to 26*g* which acts in cooperation with the selected pin 28. This movement in the range of the rotation angle 0°–150° of the shaft 27, and accordingly the print shaft 5, positions the barrel cam 26 for selecting a character (FIG. 6), and in the range of 150°–230°, locks the print head 7, strikes the head 7 on the platen 2 for printing and disengages from the locking of the head 7, and finally in the range of 230°–360°, returns to the initial position of the barrel cam 26**.

The barrel cam 26, is so constructed as to rotate the print head 7 by −5, −3, −1, +1, +3 and +5 pitches in association with rotation of the shaft 27. To fulfill their purpose, the grooves **26*b*–*g* (FIG. 6) are given respective configurations for effecting corresponding movement of the barrel cam 26 in the range of 0°–150° of the rotation angle. Therefore, the grooves 26*b*–*g* are different from each other, but, the grooves 26*b* and 26*g*, the grooves 26*c* and 26*f*, and the grooves 26*d* and 26*e*** are symmetrically formed.

The selection grooves **26*b*–*g* of the barrel cam 26 are formed so that the depth of the grooves 26*b* to 26*g* gradually decreases in the range of 300°–345° of the rotation angle of the barrel cam 26 and the grooves 26*b* to 26*g* finally align with the outer circumference of the barrel cam 26 as seen in FIG. 3, thereby to forcibly withdraw the selector pins 28 from the grooves 26*b*–*g*. Meanwhile, the electromagnet 30 is controlled by the sequencing control block 53 (FIG. 11) and is so adapted to be excited in the range of rotation angle 0°–300° of the barrel cam 26. The gradual decrease of the depth of the grooves 26*b*–*g* and the controlled excitation of the electromagnet 30 assures a correct withdrawal of the selected and actuated selector pin 28 from each of the cam grooves 26*b*–*g* at termination of one revolution of the barrel cam 26. A set pin 32 normally engages the return cam groove 26*h*. The set pin 32 is fixed on the frame 6*b* of the carrier 6 thereby to set the barrel cam 26 back in its original position after one revolution of the shaft 27**.

Figure 7:
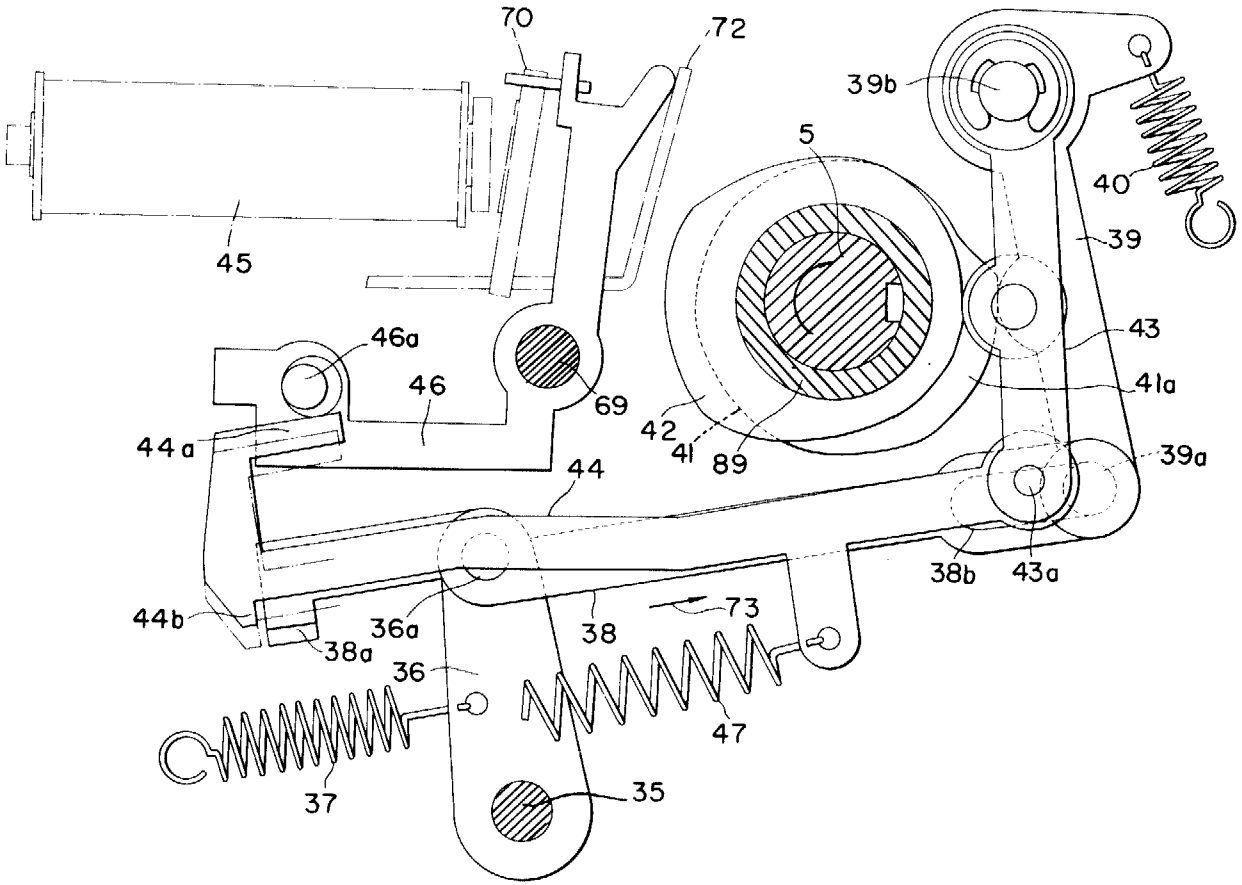
FIG. 7 is a lateral view of a mechanism for rocking a lock lever.

FIG. 7 illustrates the structure of the input means including the lock lever 34. A rod 35 fixedly carrying the lock lever 34 has a lever 36 fixed at its leftward end (in FIG. 4) and is urged in counterclockwise direction in FIG. 7 by a tension spring 37 extended between the lever 36 and the base plate 11. A swingable link 38 is pivoted at the top end of the lever 36, the swingable link 38 having protruding at one end portion a laterally bent portion **38*a* and a slot 38*b* formed at the other end portion. In the slot 38*b* is slidably inserted a pin 39*a* fixed at the tip of a first follower lever 39. The follower lever 39 is rotatably pivoted about an axis 39*b* fixed to the side wall 6*a* of the frame 6*b* of the carrier 6 and urged by a tension spring 40 into contact with a first cam 41 mounted on the sleeve 89. The first cam 41 holds, in its initial position, the first follower lever 39 in the position shown in FIG. 7 through an offset diameter portion 41*a* against the force of the tension spring 40. Through the connections of the pin 39*a*, the swingable link 38, the lever 36 and the rod 35, the lock lever 34 retains its top end 34*a* in the communicating portion 33*e* of the cam slot 33**.

A second cam 42 is mounted on the sleeve 89. A second follower lever 43 pivoted about the axis **39*b*, is provided in association with the second cam 42. A lever 44 is pivoted at the tip end 43*a* of the second follower lever 43 and the leftward end of the lever 44 has a contact portion 44*a* and an engaging portion 44*b*. In correspondence with the lever 44 an electromagnet 45 similar to the electromagnet 30 is provided in the actuator block 59, and in correspondence with the electromagnet 45, a bellcrank 46 is pivotally mounted on the rod 69. The bellcrank 46 has an adjustable eccentric pin 46*a* in a top portion of its one arm, i.e., in a position wherein the pin 46*a* aligns with the contact portion 44*a* of the lever 44. The lever 44 is urged in clockwise direction around the axis 43*a* through a tension spring 47 extending between the carrier frame 6*b* and the lever 44. The clockwise rotation of the lever 44 is checked by engagement of the contact portion 44*a* with the eccentric pin 46*a*. The bellcrank 46 is restricted from its clockwise rotation by the stop member 72. Thus, when the electromagnet 45 is excited, the bellcrank 46 is urged to rotate counterclockwise thereby to displace the lever 44** from the position shown by a solid line to the position shown by a dotted line in FIG. 7.

With rotation of the main shaft 5, the first and second follower levers 39 and 43 are respectively rocked along the contours of the cams 41 and 42. The first follower lever 39, at initiation of rotation of the cam 41 (0°-30°), rotates in a clockwise direction around the axis 39b through the cam contour of the cam 41 and the action of the spring 40, and in the later period of the rotation of the cam 41 (220°-310°) rotates counterclockwise to return. The second follower lever 43, at 20°-150° rotation of the cam 42, is forced to rotate around the axis 39b counterclockwise through the cam contour of the cam 42 and at the 220°-310° rotation of the cam 42, is pivoted clockwise to return by the spring 47. In association with the rotation of the lever 43, the lever 44 first moves rightward in FIG. 7 and then returns leftward.

The engaging portion 44b of the lever 44 is so disposed as to pass over the formed portion 38a of the swingable link 38 without engaging with the portion 38a during movement of the lever 44 when the electromagnet 45 is not excited. Therefore, if the first follower lever 39 rotates clockwise in association with the rotation of the print shaft 5 when the electromagnet 45 is not excited, the lever 36 is pivoted counterclockwise (in FIG. 7) through the action of the spring 37. As a result, the lock lever 34 rotates counterclockwise in FIG. 4 to thereby insert its tip 34a into the groove 33a or 33c of the modifying link 16.

When the electromagnet 45 is excited to push down the leftward end of the lever 44 (in FIG. 7), the travelling path of the engaging portion 44b is lowered to place the bent portion 38a within the path. Eventually, when the lever 44 moves rightward as abovementioned, the engaging portion 44b engages with the formed portion 38a thereby moving the swingable link 38 in the direction of an arrow 73 in FIG. 7 against the spring 37. In this manner, the link 38 can move freely in spite of the pin 39a, because of the connection of the pin 39a with the elongated slot 38b. In coincidence with the movement of the swingable link 38 in the direction of arrow 73, the lock lever 34 rotates clockwise in FIG. 3 whereby the top portion 34a of the lever 34 engages with the grooves 33b or 33d of the cam slot 33 in modifying link 16. Therefore, it is understood that the pivoting direction of the lock lever 34 is controlled by the electromagnet 45. Selection of one character out of 12 characters in each semicircular face is effected by a selective excitation of the electromagnets 30 and 45 in the actuator block 59 as previously explained. Selection of either of the semicircular faces, that is, selection of upper case capital letters or lower case small letters is effected through a case shift operating mechanism independent of the actuator block 59 and main shaft 5.

The case shift operating mechanism includes shift cam 19 (FIG. 4). The cam 19 is connected to a shift shaft 22 through an integral gear 20 rotatably mounted on a rod 63 which is fixed onto the side wall 6a of the carrier 6, and another gear 21 meshing with the gear 20. The gear 21 is keyed on the shift shaft 22 and rotatably therewith and axially movable, and is so constructed as to travel with the gear 20 meshed therewith together with the carrier 6. One revolution of the gear 21 coincides with half a revolution of the gear 20. The shift shaft 22 is connected through a cycle clutch 24 (FIG. 2), to an output shaft of the actuating motor. The cycle clutch 24 is connected to a shift key 23 provided on the keyboard 1 in such a manner that the clutch 24 engages in response to depression and release of the case shift key 23 thereby permitting one complete revolution of the shift shaft 22, respectively. Thus, when the shift shaft 22 effects one revolution in response to the depression of the shift key 23, the shift cam 19 rotates 180° forcing its raised cam portion 19a to press the roller 17 thereby displacing the roller 17 to a position shown by the dotted line from the position shown by the solid line, against the spring 18 in FIG. 4. Printing of the upper case letters, i.e. capital letters can be effected when the keys 1a on the keyboard 1 are operated in this situation. When the shift key 23 is released, the shift cam 19 rotates a further 180° facing its lower cam portion to the roller 17 and eventually the modifying link 16 and accordingly the axle 15b are restored to their initial positions urged by the spring 18 as shown in FIG. 4. It is, therefore, understood that the case shift mechanism including the shift cam 19 acts as an input means for the modifying link 16 and the axle 15b.

Figure 8:
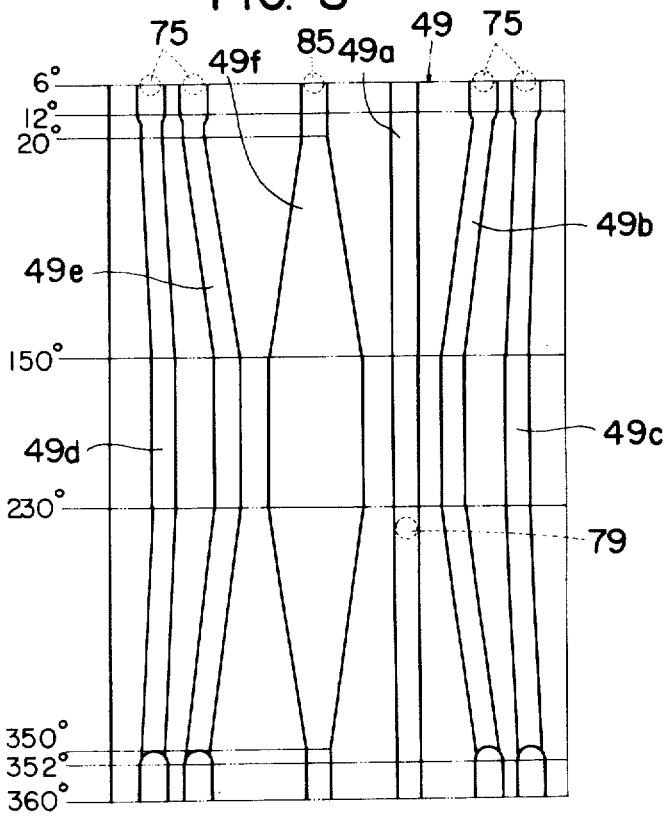
FIG. 8 is a developed view of a second barrel cam.

The mechanism for tilting the print head 7 for selecting a row for a character to be printed, employs a barrel cam similar to that applied to selection of columns. This second barrel cam 49 (FIGS. 2 and 3) is mounted on a shaft 48 for rotation therewith and axial translation thereon. The shaft 48 is connected to the main shaft 5 at a transmission ratio of 1:1 through the gearing 61. The barrel cam 49 includes a follower cam groove 49a, four selection cam grooves 49b, 49c, 49d and 49e, and a return cam groove 49f (FIG. 8).

A selector pin 75 is provided for each of the selection grooves 49b-e. The selector pins 75 are urged by springs 74 (FIG. 3). Relative to each of the selector pins 75 is arranged on electromagnet 76 in the actuator block 59. The electromagnets 76 are respectively related to levers 77 pivoted about rod 69 through the armatures 70. Each of the levers 77 has a lower arm portion extending into contact with a leftward end (in FIG. 3) of the respective selector pin 75. Therefore, when the electromagnet 76 is selectively excited, the corresponding selector pin 75 enters into one of the selection grooves 49b-e of the barrel cam 49 against the spring 74. Into the follower groove 49a of the second barrel cam 49 is usually inserted a follower pin 79 which is fixed to a follower arm 78. The arm 78 is screwed on a cross bar of a bail 80 axially movably mounted on the rod 50 which is a rocking pivot of the rocker 8. The bail 80 has a pin 80a slidably inserted in a guide groove 81a which is formed, in parallel to the rod 50, in a guide plate 81 screwed on the carrier frame 6b, thereby checking rotation of the bail 80 relative to the rod 50 for securely retaining the follower pin 79 in the follower groove 49a of the barrel cam 49.

The rod 50 is further provided with a small drum 82 (FIG. 2) which is axially slidable along with the bail 80. A plurality of annular grooves 82a are formed on drum 82, the annular grooves 82a engaging with teeth formed in a sector arm 83b of bellcrank 83 which is pivoted at 83a on the rocker 8. This engagement is maintained irrespective of the rocking position of the rocker 8 by bringing the rocking axis of the rocker 8 in line with the rod 50. Another arm of the bellcrank 83 is connected to the print head 7 through a link 84 (FIG. 3).

Thus constructed, when the print shaft 5 rotates one revolution eventually effecting one revolution of the shaft 48 through the gearing 61, the barrel cam 49 rotates and axially moves on the shaft 48 following a contour of one of the selected cam grooves 49b-e. Then the bail 80 and the drum 82 reciprocate on the rod 50 through the engagement of the follower pin 79 with the follower groove 49*a* of the barrel cam 49 thereby rocking the bellcrank 83 around the pivot 83*a* through the engagement of the teeth on the bellcrank 83 with the grooves 82*a* in the drum 82. This rocking of the bellcrank 83 is transmitted to the printing head 7 through the link 84 to tilt the head 7. Thus similar to selection of the rotation direction of the print head 7, the tilting motion of the head 7 corresponding to the displacement of the barrel cam 49 i.e., selection of character rows is completed.

FIG. 8 illustrates the contours of the grooves 49*a–f* of the barrel cam 49. The grooves 49*b* and 49*e*, and the grooves 49*c* and 49*d* are respectively symmetrically formed as seen in the drawing. Further, the grooves 49*b–e* are so shaped as to tilt the print head 7 by $+1\frac{1}{2}$, $+\frac{1}{2}$, $-\frac{1}{2}$, $-1\frac{1}{2}$ pitches, when downward or clockwise (in FIG. 3) tilting of the print head 7 is represented as "+" and a tilting pitch corresponding to one line distance is represented as 1 pitch. In the ordinary position, the print head 7 is so disposed that an intermediate blank between the second line and the third line falls on the printing position facing the platen 2. It is apparent, therefore, that when the grooves 49*b*, 49*c*, 49*d* and 49*e* are selected, the first, second, third and fourth lines are selected respectively.

For a correct return of the barrel cam 49 there is provided a set pin 85 normally engaged in the return cam groove 49*f* in approximately the same plane as the selector pins 75 as shown in FIG. 8, which is omitted in FIG. 3.

Figure 12:
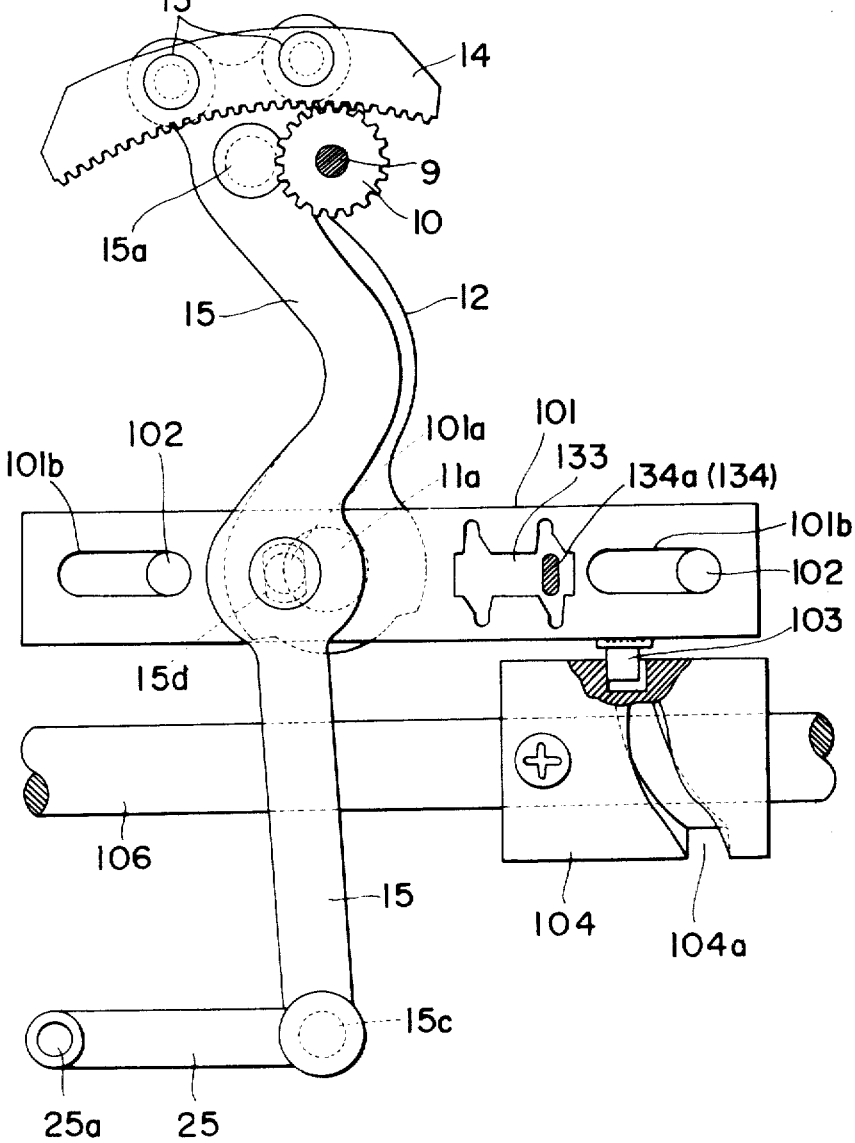
FIG. 12 is a plan view similar to FIG. 4 showing a second embodiment of a mechanism for selecting a column of characters.

FIG. 12 shows another embodiment of the mechanism controlling the rotation of the print head 7, that is, selection of the character columns according to the present invention, wherein like members are identified as in the first embodiment.

Referring to FIG. 12, instead of the modifying link 16, a modifying plate 101 is used which is guided by a pair of guide pins 102 fixed to a base plate (omitted in FIG. 12) similar to the base plate 11 and a pair of guide slots 101*b* for slidable movement in a direction approximately perpendicular to the rocking plane of the print head 7. The modifying plate 101 is connected to the operating link 15 through connection between the pin 101*a* and an elongated slot 15*d*. The operating link 15 is connected to the lever 12 with the pin 15*a* and connected to the follower link 25 of the first barrel cam 26 with the pin 15*c*. Though the pin-and-slot connection 101*a*, 15*d* is not used between the lever 12 and the operating link 15, but is used between the operating link 15 and the modifying plate 101 which is, however, alternative, the arrangement of the second embodiment in FIG. 12 including the print head 7, the positioning member 9, the pinion 10, the sector gear 14, the lever 12, the operating link 15, the follower link 25 and the first barrel cam 26 is substantially the same as in the first embodiment.

Constructed as described above, when the modifying plate 101 moves in one direction, the print head 7 rotates correspondingly.

The modifying plate 101 is similarly related to the input means for selecting a semicircular face and the input means for selecting a group of character columns in the selected semicircular face. The former input means includes a cam 104 adjustably fixed to a shaft 106 on the carrier frame 6*b* which is connected to the shift shaft 22 (not shown in FIG. 12) at a rotation ratio of 1:2. The cam 104 engages a follower pin 103 fixed to a bent portion formed in one side of the plate 101 thereby to displace the modifying plate 101 at every half revolution of the shaft 106 by a distance corresponding to a rotation angle of 180°, i.e., half a revolution of the print head 7 following a closed cam groove 104*a*. Thus, the modifying plate 101 is displaced to the shifted position rightward in FIG. 12 with the shift key 23 pressed down and to the initial leftward position with the shift key 23 released, whereby selection of the upper case characters or lower case characters can be completed as in the first embodiment.

Figure 13:
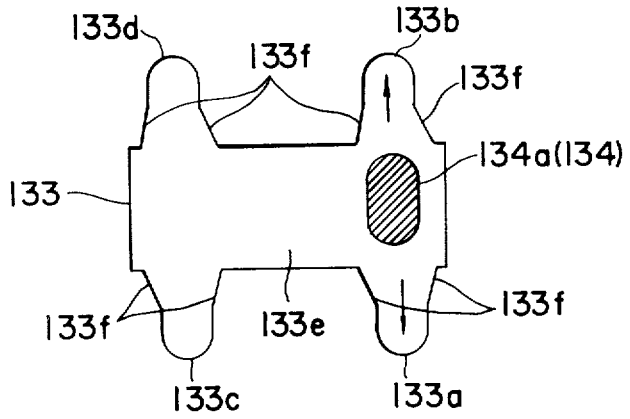
FIG. 13 is an enlarged view showing contours of grooves in a modifying plate in FIG. 12.

The modifying plate 101 is formed with a cam slot 133 of a similar contour to the cam slot 33 in the modifying link 16 adapted to cooperate with a lock lever 134 which is provided for the same purpose as the lock lever 34 for selecting a group of letter columns. FIG. 13 more particularly illustrates the contour of the cam slot 133, which has four locking grooves 133*a*, 133*b*, 133*c* and 133*d* and a communicating portion 133*e*. The grooves 133*a* and 133*b*, and the grooves 133*c* and 133*d* are respectively disposed with a distance corresponding to one pitch revolution of the print head 7 in a traveling direction of the plate 101. Moreover, the distance between respective grooves 133*a* and 133*c*, and grooves 133*b* and 133*d* is defined to correspond to 180°i.e. half a rotation of the print head 7. The modifying plate 101 is further formed with cam edges 133*f* diagonally cut on both sides of the respective grooves 133*a–d* for enabling the grooves 133*a–d* to receive a top portion 134*a* of the lock lever 134. Therefore, when the lock lever 134 rocks to move its top portion 134*a* in either direction of arrows in FIG. 13, the modifying plate 101 either in its original or shifted position moves through the cam action between the top 134*a* and the cam edges 133*f* so that any of the grooves 133*a*, 133*c*, 133*b* and 133*d* accepts the top portion 134*a* whereby selection of a group of character columns is performed.

In order to receive the top portion 134*a* of the lever 134 in either of the grooves 133*a* and 133*b*, and the grooves 133*c* and 133*d* irrespective of rotation direction of the lock lever 134, the modifying link 101 must be displaceable by the distance between the grooves 133*a*, 133*b* and the grooves 133*c*, 133*d* in the traveling direction in its initial or shifted position. For the above purpose, the width of the cam groove 104*a* of the cam 104 is so defined as to permit displacement of the modifying link 101 in the direction with a distance slightly greater than, but less than twice, the distance between the grooves 133*a* and 133*b* and the grooves 133*c* and 133*d*. Accordingly, the spring 18 used for the link 16 in the first embodiment is omitted in this case.

With the embodiment as disclosed in FIG. 12, selection of the character columns on the print head 7 can be effected by operating the shift cam 104, the lock lever 134 and the first barrel cam 26.

Figure 14:
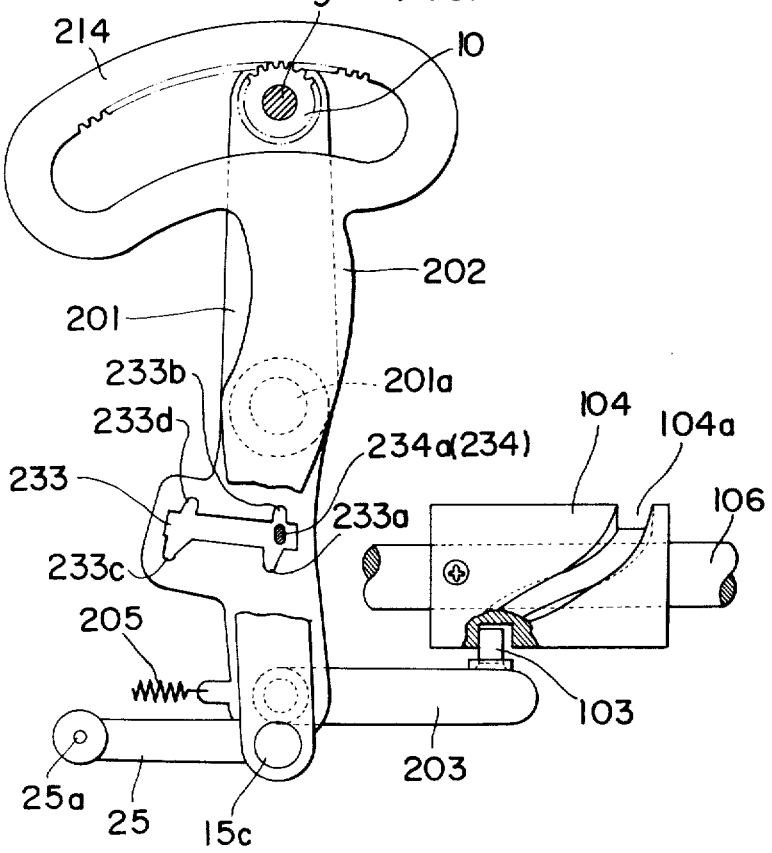
FIG. 14 is a plan view similar to FIG. 4 showing a third embodiment of a mechanism for selecting a column of characters.

FIG. 14 shows a third embodiment of the present invention, wherein identity of numbers and members are as in the first and the second embodiments. A link 201 is pivoted about the rotary shaft 9 which carries the pinion 10. On the link 201 is pivotally mounted a further link 202 with an integral rack 214 about an axle 201*a*. The link 202 and rack 214 rotate around the axle 201*a*. The follower link 25 which is the follower member of the barrel cam 26 is connected to link 202 through pin 15*c*.

Similar to the first and the second embodiments, two input means are related to the link 201. On a free end of the link 201, is pivotally mounted a link 203 fixedly carrying the pin 103, which is the follower member of the cam 104 as in the second embodiment. Therefore, the link 201 rotates around the shaft 9 in response to operation of the shift key 23 to thereby be shifted between its initial and shifted positions.

In the middle portion of the link 201 is formed a cam slot 233 similar to the cam slots 33 and 133 comprising similarly four locking grooves 233*a* to 233*d* to cooperate with a tip 234*a* of a lock lever 234. Since the link 201 is rotatably mounted on the shaft 9, the cam slot 233 is so configured that the locking grooves 233*a*–233*d* are radial from the shaft 9. The link 201 is urged clockwise around the shaft 9 with a spring 205, which can be omitted by providing cam edges on both sides of the four grooves 233*a*–233*d* of the cam slot 233 as in the second embodiment.

It will be clearly understood that with the abovementioned construction of the embodiment shown in FIG. 14, selection of the character column on the print head 7 can be performed by operating the shift cam 104, the lock lever 234 and the first barrel cam 26.

Figure 15:
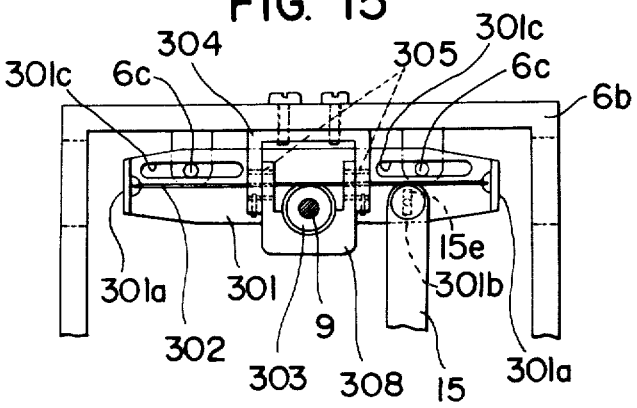
FIG. 15 is a plan view showing another connecting method of an operating link and a print head.

FIG. 15 shows another embodiment of a structure connecting an operating link 15 and the shaft 9 for the print head 7. An output end of the operating link 15 similar to that of the first and second embodiment, is operably connected to a movable plate 301 through a pin-and-slot 301*b*, 15*e* connection which is supported on the carrier frame 6*b* movably through a pin and slot guide 6*c*, 301*c* in parallel to the printing line. The movable plate 301 has on both of its ends bent portions 301*a* respectively. Extending between the bent portions 301*a*, is a cord or string 302 tensioned in parallel to the printing line with its ends fitted to both the formed portions 301*a*. The cord or string 302 is preferably made of steel for minimizing elasticity.

The cord 302, in its middle portion, is wound on pulley 303 fixed to the rotary shaft 9 for the print head 7 with a portion suitably fitted to the pulley 303. When the movable plate 301 moves relative to the carrier frame 6*b* in parallel to the print line, the shaft 9 and the print head 7 are forced to rotate through the cord-and-pulley 302, 303 connection thereby performing selection of the character column.

A rocker 308 rotatably supporting the shaft 9 is swingably held by a pair of sleeves 305 which are mounted on a support member 304 fixed to the carrier frame 6*b*. The sleeves 305 are so arranged that the cord or string 302 substantially aligns with the central line of the sleeve 305. In the printing operation, the rocker 308 is forced to rotate around the cord or string 302. In this manner, the cord 302 is freed of unfavorable effects of the rocking motion of the rocker 8, such as tensile force, irrespective of the position of the movable plate 301.

As described in the present embodiment, the operating link 15 and the print head 7 are operatively connected through the cord or string-and-pulley connection instead of a gear and a pinion.

Referring back to FIG. 14, it is to be added that a rack movably mounted similar to the movable plate 301 in FIG. 15 and operated by the separate link 15 can be employed in the third embodiment instead of the rack 214 formed integrally with the link 202.

The present invention may be embodied in other specific forms without departing from the spirit or essential characteristics thereof. The presently disclosed embodiments are therefore to be controlled in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. In a selection mechanism for a single element printer including a single print element having first and second pluralities of characters carried thereby and a case shift key having two positions corresponding respectively to said first and second pluralities of characters, the improvement comprising:

(a) an operating link connected to said print element for rotating said print element, said operating link having first and second input portions;

(b) a modifying member supporting said operating link for pivotal motion about said first input portion;

(c) a case shift cam having two operative positions corresponding to said two positions of said case shift key;

(d) a cam follower mounted on said modifying member for engaging said case shift cam to shift said modifying member and thereby said first input portion of said operating link between a pair of locations, said modifying member being movable to two or more character selection positions within either of said locations thereof;

(e) first character selection means operably coupled to said modifying member in either of said locations for positioning said first input portion of said operating link to any of said character selection positions; and (f) second character selection means operably coupled to said second input portion of said operating link for positioning said operating link to any of a predetermined plurality of pivotal positions relative to said first input portion thereof.

2. A selection mechanism as claimed in claim 1 including a spring for urging said modifying member in a direction such that said cam follower engages said case shift cam, said modifying member having a pair of cam means cooperable with said first character selection means to selectively displace said modifying member to one of said character selection positions in a direction opposite to the direction of urging of said spring.

3. A selection mechanism as claimed in claim 2 wherein said modifying member and thereby said first input portion of said operating link are lockable to any of said character selection positions, and said second character selection means is operable to lockably position said operating link to any of said pivotal positions.

4. A selection mechanism as claimed in claim 3 wherein said second character selection means includes a connecting link connected to said operating link at the second input portion thereof, a multichannel barrel cam supported for rotation about and translation along its axis, a plurality of fixed selection pins each selectively engageable with one of said channels, and a cam follower on said connecting link for transmitting the axial movement of said cam to said operating link.

5. A selection mechanism as claimed in claim 1 wherein said case shift cam is a barrel cam mounted for rotation about its axis and having a cam groove thereon, and said cam follower on said modifying member is a pin engaged in said cam groove on said barrel cam, said cam groove having a width in the axial direction of said barrel cam sufficient to allow the movement of said modifying member between said character selection positions.

6. A selection mechanism as claimed in claim 1 wherein said modifying member is a pivotable lever mounted for pivotal motion about an axis, said lever including a first arm having said operating link supported thereon and a second arm having said cam follower mounted thereon.

7. A selection mechanism as claimed in claim 6 wherein said lever has a camming slot operable with said first character selection means to lock said lever against pivotal motion about said axis after said lever is positioned in any of said character selection positions.

8. In a selection mechanism for a single element printer having a single print element, the improvement comprising:

(a) an operating link connected with said print element for rotating said print element, said operating link having first and second input portions;

(b) a modifying member supporting said operating link for pivotal motion about said first input portion and mounted for shifting movement to shift said first input portion between a pair of locations, said modifying member having a camming slot formed therein;

(c) a movable member engaged in said camming slot and disposed to be moved from an initial position in either direction perpendicular to the shifting direction of said first input portion thereby positioning said first input portion to either of a pair of character selection positions; and (d) means connected to said operating link at said second input portion for positioning said link to any of a predetermined plurality of pivotal positions relative to said first input portion thereof.

9. A selection mechanism as claimed in claim 8 wherein said movable member is a pivotable lever having one end connected to a rotatable rod having an axis parallel with said shifting direction to provide for pivotal motion of said lever in a plane perpendicular to said shifting direction, the opposite end of said lever extending into said camming slot of said modifying member.

10. A selection mechanism as claimed in claim 8 wherein said camming slot of said modifying member has an H shape including two pairs of opposed branches for receiving therein said movable member to lock said modifying member and a widened communicating portion extending between said branches, said movable member having an initial position between a pair of said opposed branches of said camming slot in either location of said modifying member, the two opposed branches of the pair being offset to define a pair of said character selection positions of said modifying member, said modifying member having cam edge means adjacent either of said pairs of opposed branches of said camming slot to guide said movable member into said branches for camming said modifying member into said character selection positions when said movable member is moved.

11. A selection mechanism as claimed in claim 10 wherein said modifying member includes a pair of relatively adjustable portions, one of said pair of relatively adjustable portions having said operating link supported thereon, the other of said pair of relatively adjustable portions having said camming slot formed therein.

12. In a selection mechanism for a single element printer having a single print element, the mechanism comprising a multichannel barrel cam supported for rotation about and translation along its axis, a plurality of fixed selection pins each selectively engageable with one of said channels, and a cam follower to transmit the axial translation of said cam, the improvement comprising:

(a) an operating link having at an end thereof an output portion connected to said print element for rotating said print element, said link further having first and second input portions;

(b) a modifying member supporting said operating link for pivotal motion about said first input portion;

(c) input means for positioning said modifying member to position said first input portion of said operating link to any of a predetermined plurality of character selection positions;

(d) means for connecting said cam follower to said operating link at said second input portion thereof whereby when said barrel cam is axially translated, said operating link is positioned to any of a predetermined plurality of pivotal positions relative to said first input portion thereof; and (e) a locking member cooperable with said modifying member for locking said first input portion of said operating link in position after said operating link is positioned by said input means and said barrel cam.

13. A selection mechanism as claimed in claim 12 wherein said modifying member includes a plurality of notches for receiving therein said locking member to lock said modifying member and said first input portion of said operating link to any of said character selection positions.

14. A selection mechanism as claimed in claim 12 wherein said input means includes first and second input members said first input member being a cam member having two operative positions, said modifying member having thereon cam follower means engageable with said cam member to shift said modifying member between two locations corresponding to said operative positions of said cam member, said modifying member being movable to two or more character selection positions within either of said locations thereof, said second input member being said locking member for positioning said modifying member to any of said character selection positions and thereafter locking said modifying member in said position.

15. A selection mechanism as claimed in claim 14 wherein said cam member is a case shift cam positionable to said operative positions in response to depression and release of a case shift key.

16. In a selection mechanism for a single element printer having a single print element, the improvement comprising:

(a) an operating link connected to said print element for rotating said print element, said operating link having first and second input portions;

(b) a modifying member supporting said operating link for pivotal motion about said first input portion, said modifying member having a camming slot formed therein;

(c) a pivotable lever having a free end disposed for engagement in said camming slot of said modifying member;

(d) selectively operable means for selectively pivoting said lever in a first or second direction to position, through camming engagement of said lever in said slot of said modifying member, said first input portion of said operating link to either of a pair of positions; and (e) means connected to said operating link at said second input portion for positioning said link to any of a predetermined plurality of pivotal positions relative to said first input portion thereof.

17. A selection mechanism as claimed in claim 16 wherein said selectively operable means includes first cyclically operable means for pivoting said pivotable lever in said first direction, second cyclically operable means for pivoting said pivotable lever in said second direction, and alternative means operable to selectively render said second means operative thereby to permit said lever to be pivoted in said first or second direction.

18. A selection mechanism as claimed in claim 17 wherein said first cyclically operable means includes a link connected with said pivotable lever for pivoting said lever; means for urging said link connected with said pivotable lever in a direction and said pivotable lever in said first direction; a cyclically driveable cam for rendering said urging means operative to move said link connected with said pivotable lever in said direction and pivot said pivotable lever in said first direction; and a cam follower having a lost motion connection with said link connected with said pivotable lever for allowing said link connected with said pivotable lever to be positively moved in the reversed direction during movement of said cam follower.

19. A selection mechanism as claimed in claim 18 wherein said second cyclically operable means includes a control lever disposed adjacent and in parallel with said link connected with said pivotable lever of said first cyclically operable means and having a projection for engagement with said link connected with said pivotable lever; a cam follower lever having thereon said control lever articulated at the free end thereof; a cyclically driveable cam engageable with said follower lever for moving said link connected with said pivotable lever, when said projection of said control lever is brough into engagement with said link connected with said pivotable lever in said reversed direction to pivot said pivotable lever in said other direction; and a spring for urging said control lever to bring the projection of said control lever out of engagement with said link connected with said pivotable lever and for urging said follower lever into engagement with said cyclically driveable cam engageable with said follower lever, said alternative means being operable to bring said projection of said control lever alternatively into and out of engagement with said link connected with said pivotable lever.

20. In a printer having a movable print carrier, a print element carried by said carrier for rotation to present different characters to a print position, a plurality of character keys, a case shift key, a print shaft responsive to depression of any character key to rotate itself one cycle about the axis thereof, and a case shift shaft responsive to each depression and release of the case shift key to rotate said case shift shaft one cycle about the axis thereof, the improvement comprising:

(a) a differential mechanism mounted on said carrier and connected to said print element for rotating said print element, said mechanism including a link having an output and two input portions thereon;

(b) a case shift cam mounted on said carrier for rotation by said case shift shaft, said case shift cam having two operative positions to which said case shift cam is brought alternately upon each cycle of rotation of said case shift shaft;

(c) a cam follower engageable with said case shift cam to shift one of said input portions of said link between two positions corresponding to said two operative positions of said cam for producing a complete one-half revolution of said print element to effect a case shift; and (d) character selection means mounted on said carrier for positioning the other of said input portions of said link to any of a predetermined plurality of positions in response to depression of a character key wherein a corresponding character is positioned in said print position.

21. A printer as claimed in claim 20 including another character selection means mounted on said carrier for actuation by said print shaft and selectively operable to displace said one input portion of said link from either of said two positions to a displaced position wherein a character different from the character which is presented thereto with said one input portion is positioned in said print position.

22. In a single element printer having a carrier, a rod fixed on said carrier, a rocker mounted for rocking motion about said rod, a single print element mounted for rotating and tilting motion on and relative to said rocker, and means for driving said rocker to rock about said rod to effect a printing operation, the improvement comprising:

(a) a racked member having a circumferential rack formed thereon and mounted for slidable axial movement on said rod;

(b) a sector gear pivotally mounted on said rocker and disposed in engagement with said circumferential rack of said racked member, said sector gear being pivoted in response to the axial movement of said racked member on said rod, said sector gear being pivotable in a plane which includes said rod therein to maintain constant engagement with said racked member even when said rocker is rocked;

(c) a link connecting said sector gear with said print element for imparting the pivotal motion of said sector gear to said print element thereby tilting said print element; and (d) input means for axially positioning said racked member on said rod.

23. A single element printer as claimed in claim 22 wherein said input means includes a multichannel barrel cam supported on said carrier for rotation about and translation along an axis which is parallel to said rod, a plurality of fixed selection pins each selectively engageable with one of said channels, and a cam follower for transmitting the axial translation of said cam to move said racked member on said rod.

* * * * *